US008393693B2

(12) United States Patent
Juan et al.

(10) Patent No.: US 8,393,693 B2
(45) Date of Patent: Mar. 12, 2013

(54) RETURN DEVICE FOR A DRAWER

(75) Inventors: Teng-Yi Juan, Taipei (TW); Shih Wang Chen, Taipei (TW)

(73) Assignee: Sun Chain Metal Industry Co., Ltd., Taipei (TW)

( * ) Notice: Subject to any disclaimer, the term of this patent is extended or adjusted under 35 U.S.C. 154(b) by 0 days.

(21) Appl. No.: 13/405,076

(22) Filed: Feb. 24, 2012

(65) Prior Publication Data

US 2012/0144622 A1 Jun. 14, 2012

Related U.S. Application Data

(63) Continuation-in-part of application No. 12/346,643, filed on Dec. 30, 2008, now abandoned.

(51) Int. Cl.
*A47B 88/04* (2006.01)

(52) U.S. Cl. ..... 312/333; 312/334.44

(58) Field of Classification Search ..... 312/333, 312/319.1, 334.44, 334.46, 331, 334.1, 334.7, 312/334.8, 334.47; 384/21
See application file for complete search history.

(56) References Cited

U.S. PATENT DOCUMENTS

| | | | | |
|---|---|---|---|---|
| 7,374,261 | B1 * | 5/2008 | Wang | 312/333 |
| 7,588,299 | B2 * | 9/2009 | Yang | 312/334.47 |
| 7,600,828 | B2 * | 10/2009 | Chen et al. | 312/333 |
| 7,815,267 | B1 * | 10/2010 | Frousiakis | 312/333 |
| 8,132,873 | B2 * | 3/2012 | Yang | 312/333 |
| 8,256,853 | B2 * | 9/2012 | Chen et al. | 312/333 |
| 2005/0104492 | A1 * | 5/2005 | Chiu | 312/333 |
| 2009/0115300 | A1 * | 5/2009 | Chen et al. | 312/334.1 |
| 2009/0160299 | A1 * | 6/2009 | Chen et al. | 312/334.44 |
| 2009/0189499 | A1 * | 7/2009 | Yang | 312/334.44 |
| 2010/0164340 | A1 * | 7/2010 | Juan et al. | 312/333 |
| 2011/0043087 | A1 * | 2/2011 | Shih et al. | 312/334.1 |

* cited by examiner

*Primary Examiner* — James O Hansen
*Assistant Examiner* — Daniel Rohrhoff

(57) ABSTRACT

A return device for a drawer employs an actuator to drive a slide block, when the drawer is pulled open, the slide block is moved into a positioning concave and positioned therein while stretching an elastic member. Or pushing the drawer back can make the slide block slide out of the positioning concave, meanwhile, the elastic member pulls the drawer back to its original position. Furthermore, since the angle between the slide surface of the positioning concave of the positioning member and the track is obtuse, it is easy for the slide block to slide in and out, so that the drawer can be easily positioned and unlocked from the positioned state.

7 Claims, 10 Drawing Sheets

RETURN DEVICE FOR A DRAWER

This application is a continuation in part of U.S. patent application Ser. No. 12/346,643, which claims the benefit of the earlier filing date of Dec. 30, 2008 now abandoned. Claims 2-7 of this application correspond to Claims 5 and 7-10 of the U.S. patent application Ser. No. 12/346,643, and claim 1 of this application is revised from Claim 1 of the U.S. patent application Ser. No. 12/346,643.

BACKGROUND OF THE INVENTION

1. Field of the Invention

The present invention relates to a return device for a drawer, which is related to the slide rail of the drawer and can enable the drawer to be pushed back effortlessly.

2. Description of the Prior Art

Nowadays, people have a growing request for quality life, most of them want their home to be clear and neat, hence various storage devices are necessary. The most basic storage device in office or home is the drawer which can be used in different kinds of furniture.

Conventionally, both the drawer and the corresponding furniture must be provided with slide rails for enabling the drawer to be pulled out or pushed back. Furthermore, a return device 10 capable of returning the drawer automatically to initial position appeared on the market, as shown in FIGS. 1-3, which comprises a fixing member 11, a pulling member 12, two elastic members 13, a slide block 14 and an actuator 15. The fixing member 11 is formed with a track 111 and a positioning concave 112 at one end of the track 111. The pulling member 12 is slidably disposed on the fixing member 11 and formed with a slide slot 121. The two elastic members 13 are sleeved on the slide rod 113 and each have both ends connected to the fixing member 11 and the pulling member 12. The slide block 14 is formed with a flange 141, and a protrusion 142, 143 on each side of the flange 141. The protrusions 142, 143 can be received in the slide slot 121 of the pulling member 12 and the track 111 of the fixing member 11. The actuator 15 is formed with an actuating slot 151 for accommodation of the protrusion 142 of the slide block 14, and the protrusion 142 of the slide block 14 can be driven by the actuator 15 to slide in and out of the positioning concave 112 of the track 111. When the slide block 14 is positioned, the pulling member 12 will compress the elastic members 13, and when the slide block 14 is not positioned (disengaged from the positioning concave 14), the elastic members 13 will be decompressed to push the drawer back to its initial position.

The positioning concave 112 of the above conventional drawer returning devices is designed to be perpendicular to the sliding direction of the drawer, so that the force applied by the user to disengage the positioning member from the positioning concave 112 must be relatively large, then the drawer can be returned automatically. With countless trials and efforts, the author of the present invention has finally made a return device for a drawer, which not only can be disengaged from the positioning state easily to make the drawer move back automatically, but also is capable of effectively reducing the noise produced by the elastic member and plastic member during returning motion.

The present invention has arisen to mitigate and/or obviate the afore-described disadvantages.

SUMMARY OF THE INVENTION

The primary object of the present invention is to provide a return device for a drawer, an angle between a slide surface of the positioning concave and the track is an obtuse angle, which enables the drawer to be pushed back easily with a relatively small force, making it easier to use the drawer.

To achieve the above object, a return device for a drawer in accordance with the present invention comprises: a positioning member, a pulling member, an elastic member, a slide block, and an actuator. The positioning member has a track and a positioning concave formed at one side of the track. The pulling member is slidably disposed on the positioning member and has a slide slot. The elastic member is connected to the positioning member and the pulling member. The slide block has a protrusion to be received in the slide slot of the pulling member and a slide portion to be disposed in the track of the positioning member, and the protrusion is located close to one end of the slide portion. The actuator includes an actuating slot for receiving the protrusion of the slide block and is capable of making the protrusion of the slide bock slide in and out of the positioning concave of the track. The present invention is characterized in that: the positioning concave has a slide surface which defines an obtuse angle with respect to the track, and the obtuse angle is 235-245 degrees, at one end of the slide portion are formed an indentation and an arch-shaped top portion, the pulling member is formed on a surface thereof for slidably contacting the positioning member with an engaging portion, the engaging portion includes a slope formed in a longitudinal direction thereof, so that the top portion is able to move by pivoting against the slope of the engaging portion of the pulling member, the indentation of the slide portion makes room for a protruding corner of the slope of the engaging portion during rotation of the slide portion, so that another end of the slide portion is able to drive the protrusion to move from a slide end to a positioning end of the slide slot.

When the drawer is closed, the protrusion of the slide block is received in the bottom of the actuating slot. When the user pulls the drawer open and makes the actuator move, the actuating slot of the actuator drives the slide block to move, the slide block then moves the pulling member, and then the pulling member stretches the elastic member. When the slide block moves to the positioning concave of the track, the arch-shaped top portion of the slide portion of the slide block will slide by pivoting against the slope of the engaging portion of the pulling member, and finally the slide block will slide into the positioning concave and be positioned in place. After being positioned, the protrusion disengages from the actuating slot, so that the drawer is allowed to be pulled out into a completely open position. When the user wants to push the drawer back, the actuating slot of the drawer will hold the protrusion again and drive the slide block out of the positioning concave, which releases the pulling member from the positioned state. Meanwhile, the spring restores its shape and pulls the drawer back into the closed state. Furthermore, since the angle between the slide surface of the positioning concave of the positioning member and the track is obtuse, it is easy for the slide block to slide in and out, so that the drawer can be easily positioned and unlocked from the positioned state.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
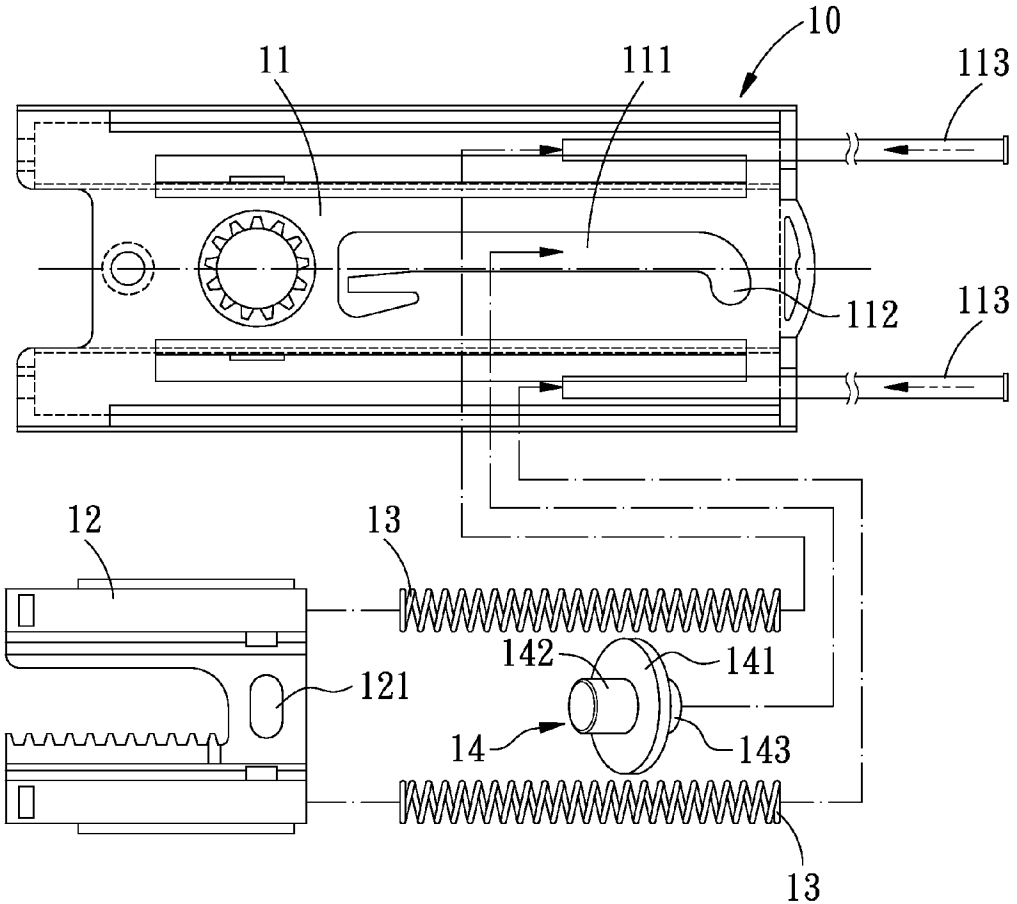
FIG. 1 PRIOR ART
FIG. 1 is an exploded view of a conventional drawer return device.
Figure 2:
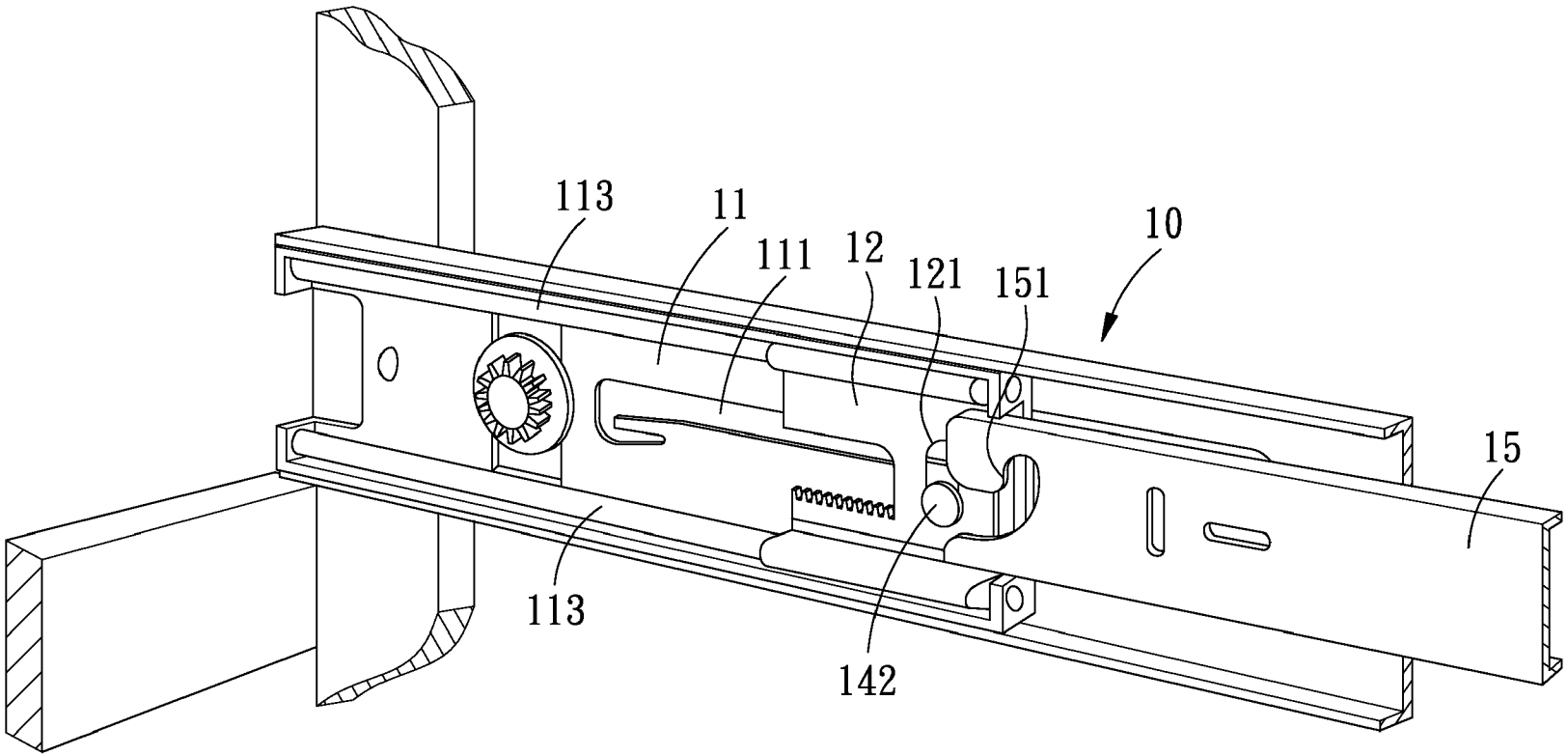
FIG. 2 PRIOR ART
FIG. 2 is a perspective view showing the status of the conventional drawer return device when the drawer is pulled.
Figure 3:
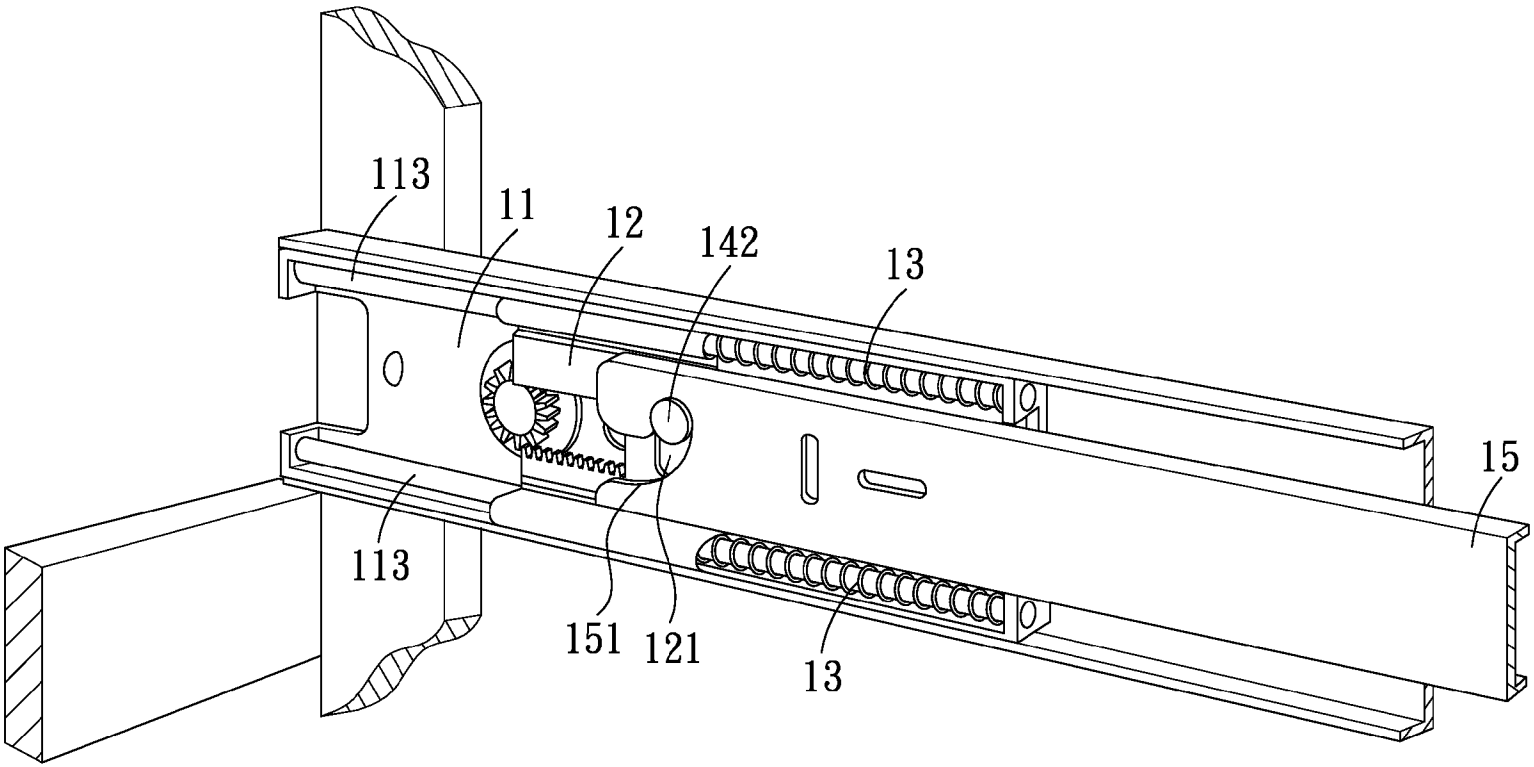
FIG. 3 PRIOR ART
FIG. 3 is a perspective view showing the status of the conventional drawer return device when the drawer is pushed back.
Figure 4:
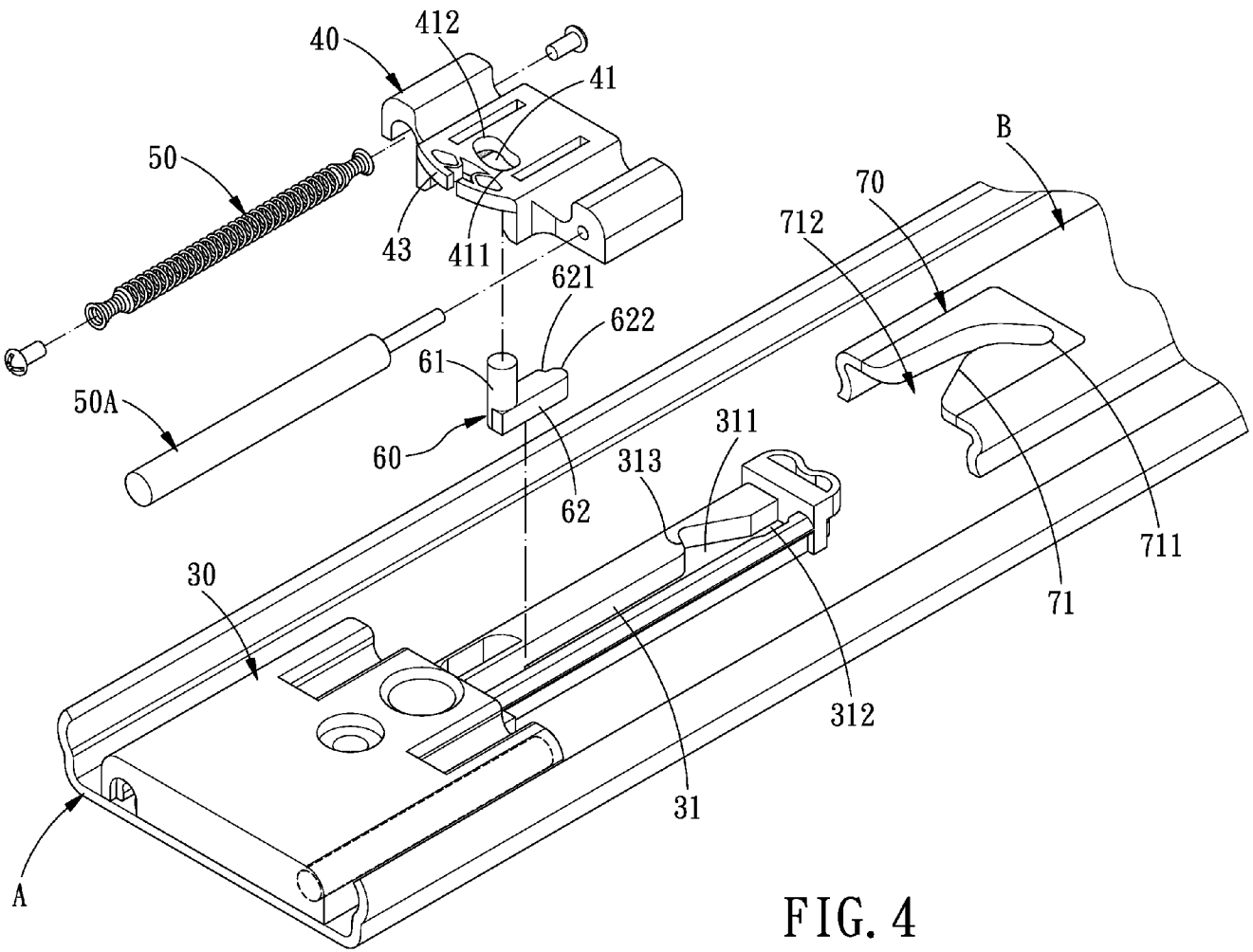
FIG. 4 is an exploded view of a return device for a drawer in accordance with the present invention.
Figure 5:
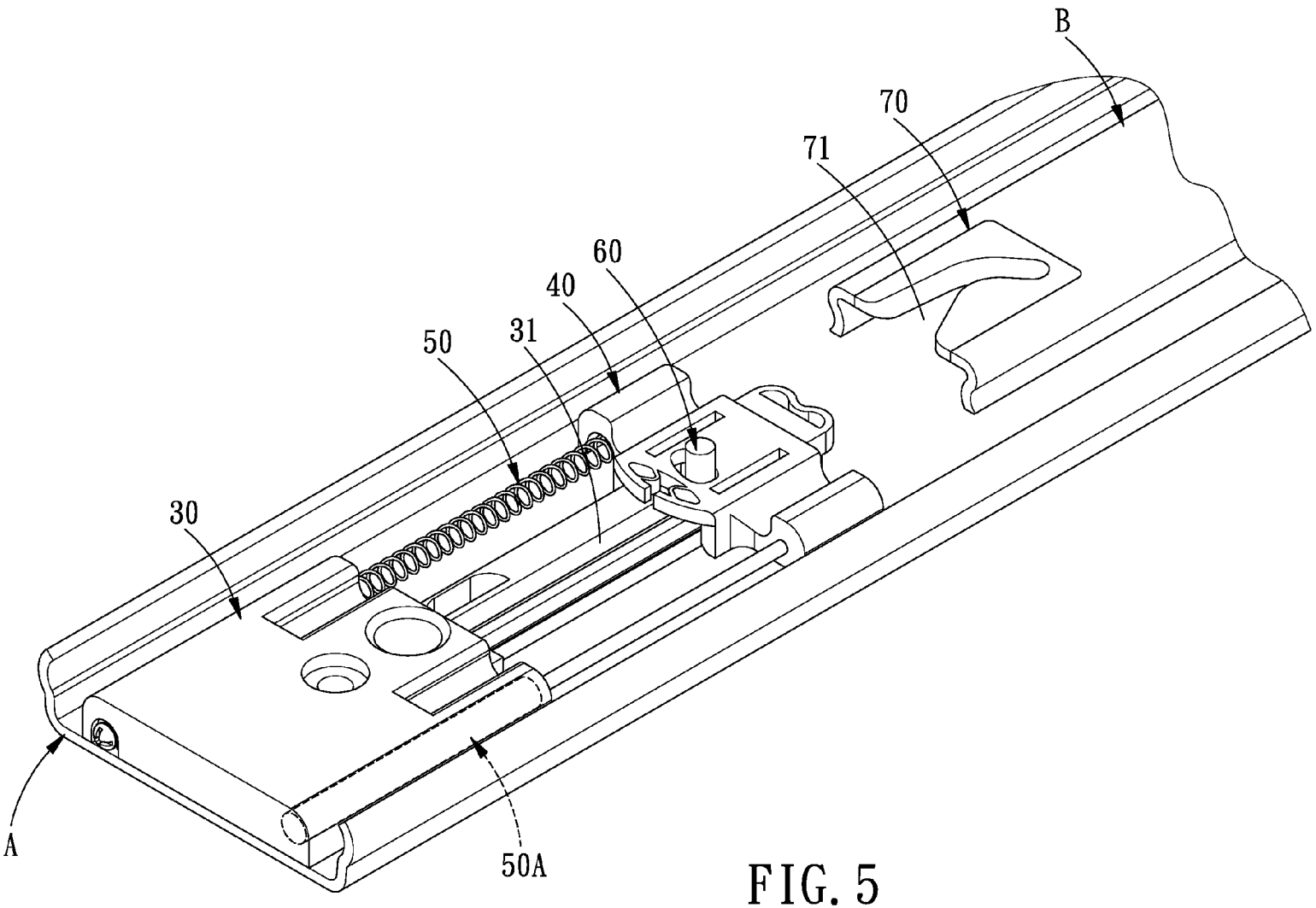
FIG. 5 is an assembly of the return device for a drawer in accordance with the present invention.
Figure 6:
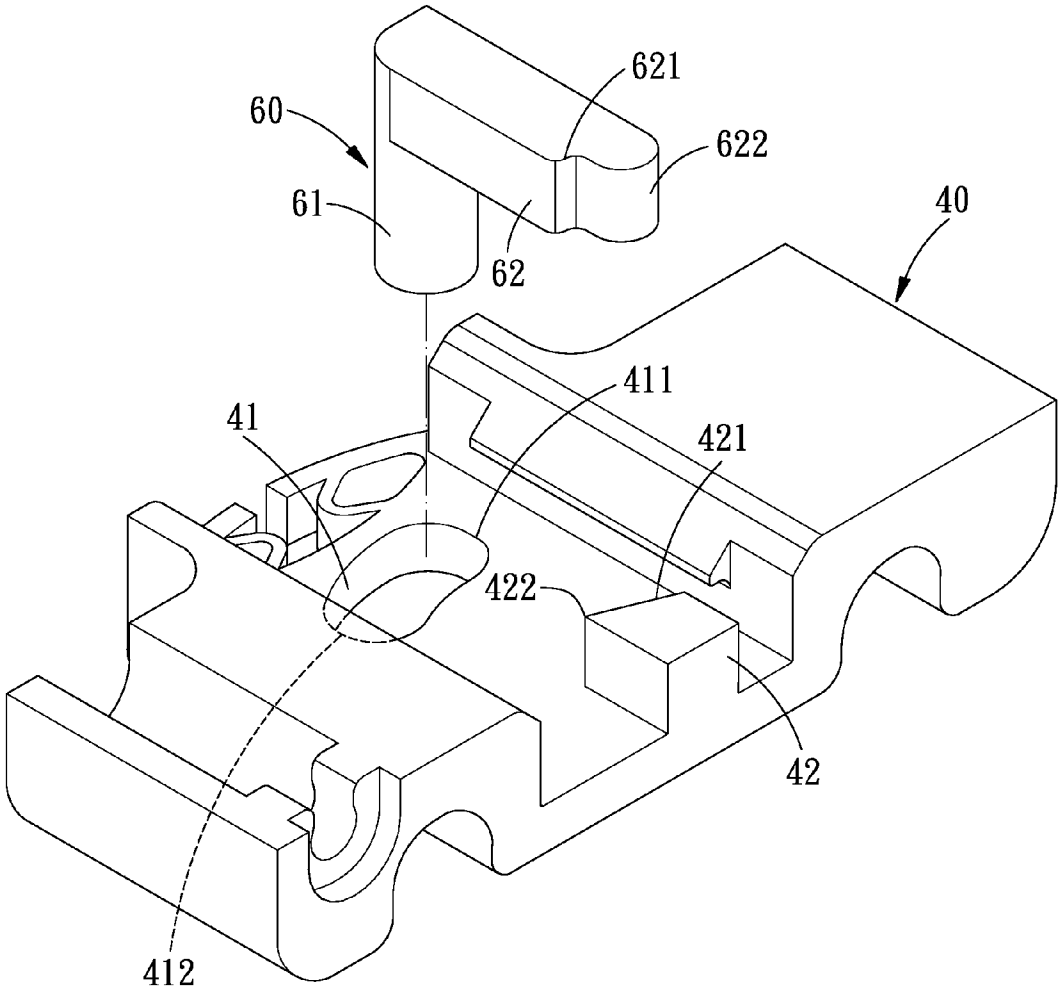
FIG. 6 shows a pulling member and a slide block of the return device for a drawer in accordance with the present invention.

Referring to FIGS. 4-6, a return device for a drawer in accordance with the present invention comprises: a positioning member 30, a pulling member 40, an elastic member 50, a buffering cylinder 50A, a slide block 60 and an actuator 70. The positioning member 30 is mounted on a base A which is to be fixed on furniture, and the actuator 70 is mounted on a pulling seat B which is to be fixed on a drawer of the furniture.

Figure 7:
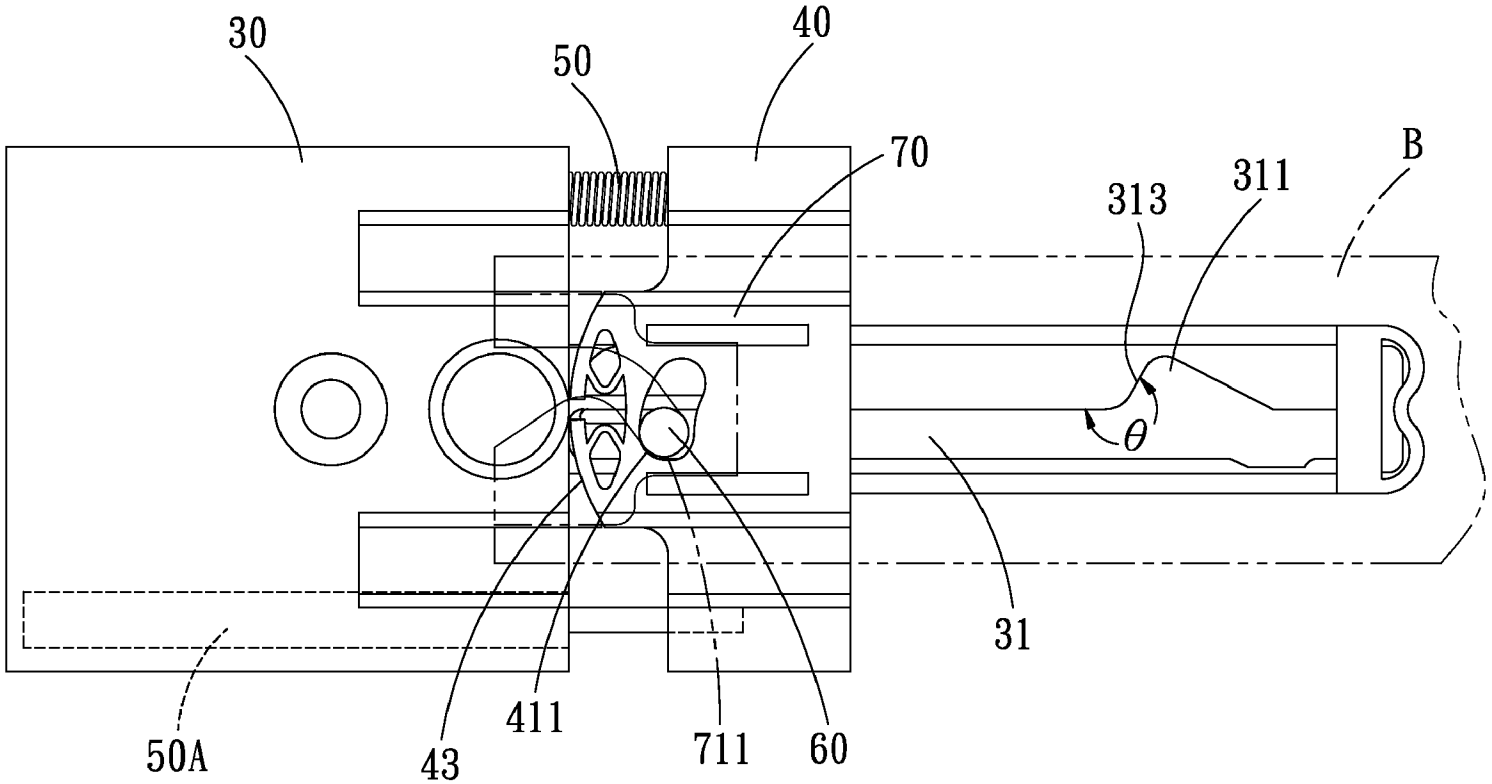
FIG. 7 is a plane assembly view showing the status of the return device for a drawer in accordance with the present invention when the drawer is closed.

The fixing member 30 includes a track 31 which is provided with a positioning concave 311 at one side and a receiving concave 312 at the other side. The positioning concave 311 has a slide surface 313 which defines an obtuse angle θ (as shown in FIG. 7) with respect to the track 31, and the angle θ is 235-245 degrees, and preferably 240 degrees.

The pulling member 40 is slidably disposed on the positioning member 30 and includes a slide slot 41 and a buffering portion 43. The pulling member 40 is formed on the surface thereof slidably contacting the positioning member 30 with an engaging portion 42. The engaging portion 42 includes a slope 421 formed in a longitudinal direction (as shown in FIG. 6), so that the engaging portion 42 becomes a trapezoid structure with the slope 421. It is to be noted that the slide slot 41 includes a slide end 411 and a positioning end 412. The engaging portion 42 and the buffering portion 43 are located at opposite sides of the pulling member 40. The slide slot 41 is located between the engaging portion 42 and the buffering portion 43. The engaging portion 42 is located at the bottom of the pulling member 40, the slope 421 is located close to the slide slot 41, and the slide end 411 of the slide slot 41 is located corresponding to the track 31 of the positioning member 30.

The elastic member 50 and the buffering cylinder 50A are disposed at both sides of the positioning member 30 and connected to the positioning member 30 and the pulling member 40, respectively. The elastic member 50 can be a spring or elastic string, and the buffering cylinder 50A can be an oil pressure cylinder, air cylinder or hydraulic cylinder, which can produce buffering effect. In this embodiment, the elastic member 50 is a spring, and the buffering cylinder 50A is an air cylinder.

The slide block 60 includes a protrusion 61 to be received in the slide slot 41 of the pulling member 40 and a slide portion 62 to be disposed in the track 31 of the positioning member 30, and the protrusion 61 is located close to one end of the slide portion 62. At one end of the slide portion 62 are formed an indentation 621 and an arch-shaped top portion 622, and the top portion 622 serves to pivotally abut against the slope 421 of the engaging portion 42 of the pulling member 40. It is to be noted that the indentation 621 of the slide portion 62 can make room for the protruding corner 422 of the slope 421 of the engaging portion 42 (namely, the slide portion 62 can be prevented from impacting the corner 422 of the engaging portion 42 during rotation), so that the other end of the slide portion 62 can drive the protrusion 61 to move from the slide end 411 of the slide slot 41 to the positioning end 412.

The actuator 70 includes an arc-shaped actuating slot 71 which is provided for accommodation of the protrusion 61 of the slide block 60 and formed with a bottom 711 and an open end 712.

Figure 8:
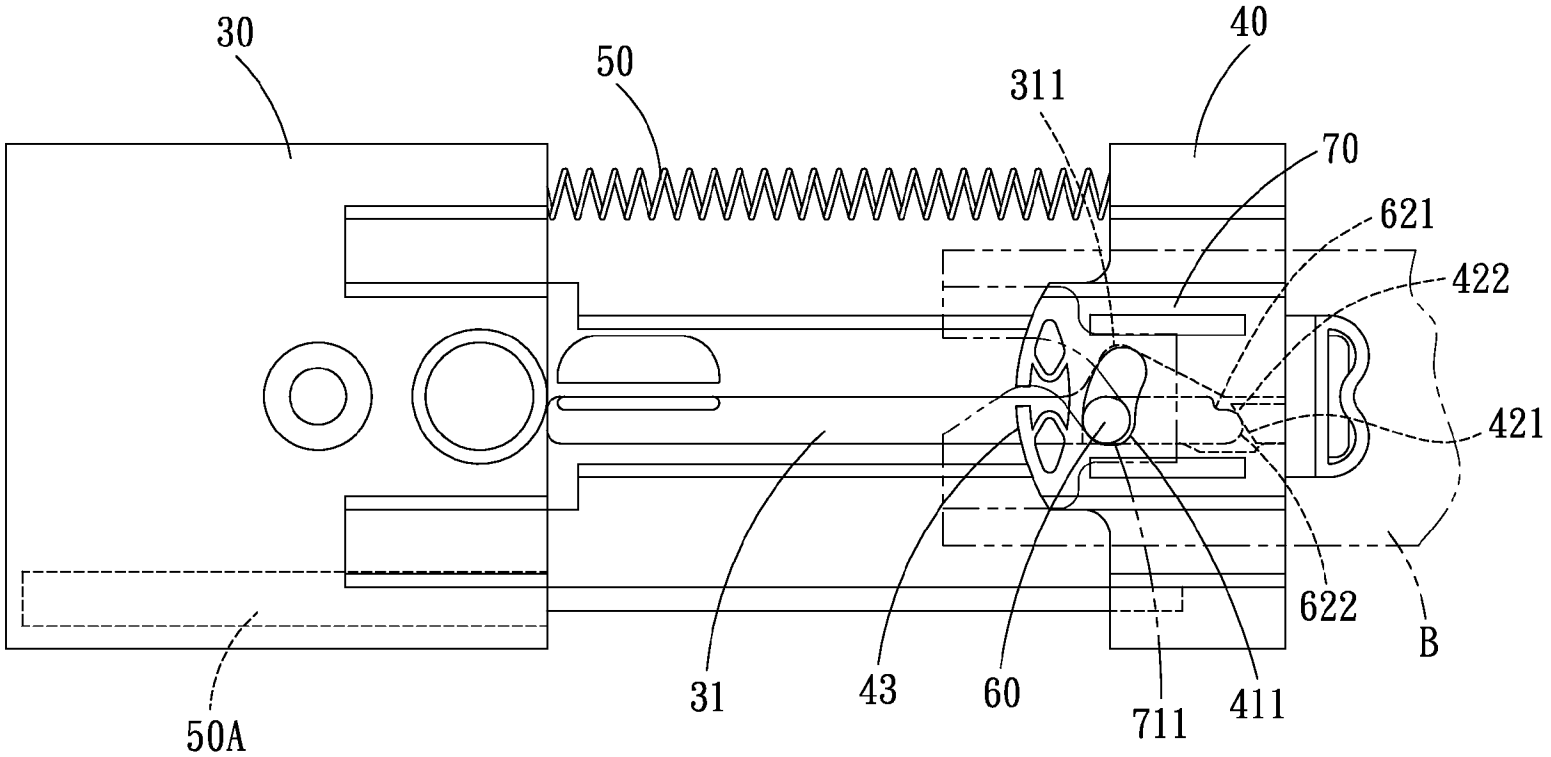
FIG. 8 is a plane assembly view showing the status of the return device for a drawer in accordance with the present invention when the drawer is pulled out.
Figure 9:
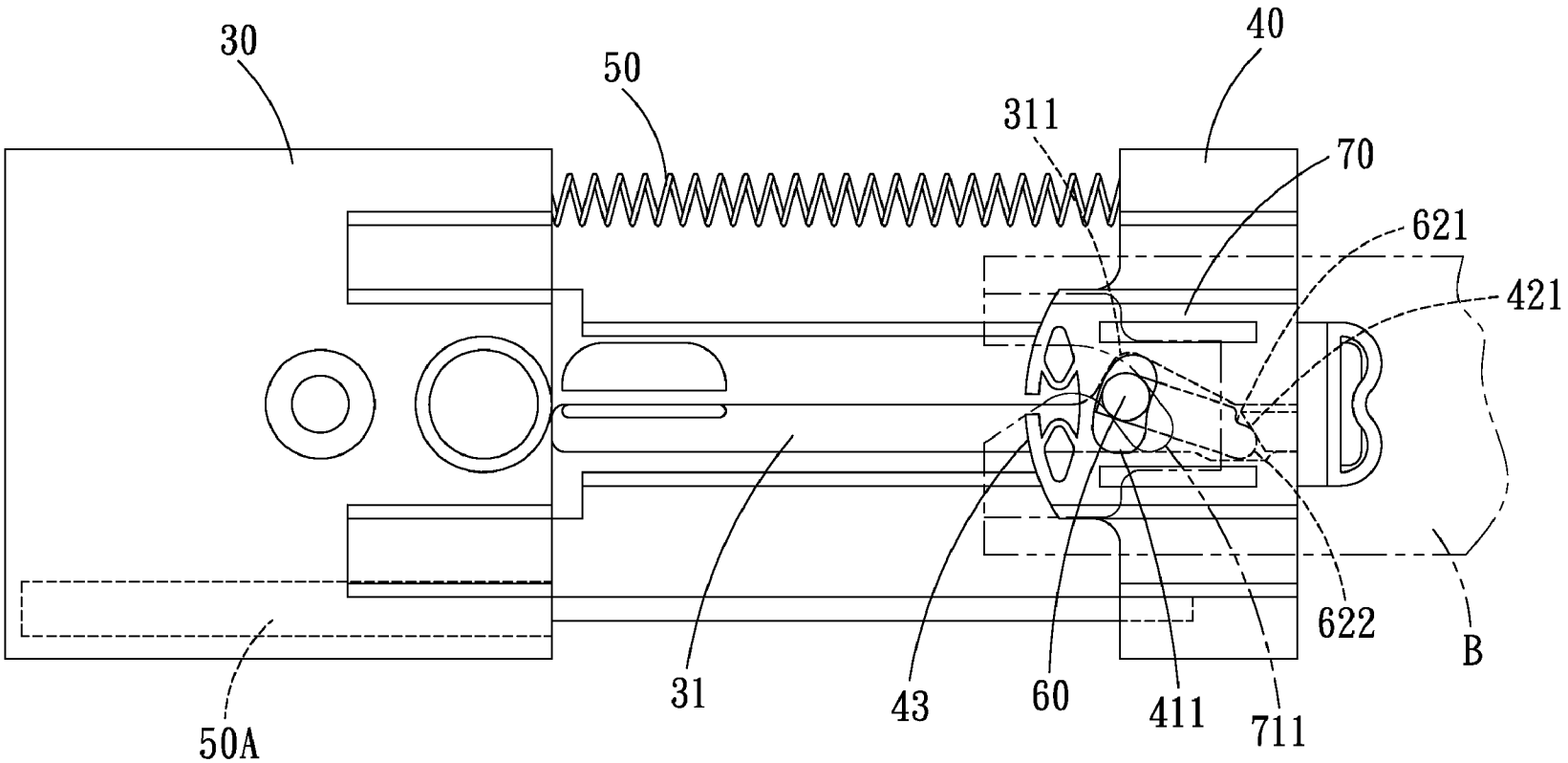
FIG. 9 is a plane assembly view showing the status of the return device for a drawer in accordance with the present invention when the drawer is pulled out but is not positioned.
Figure 10:
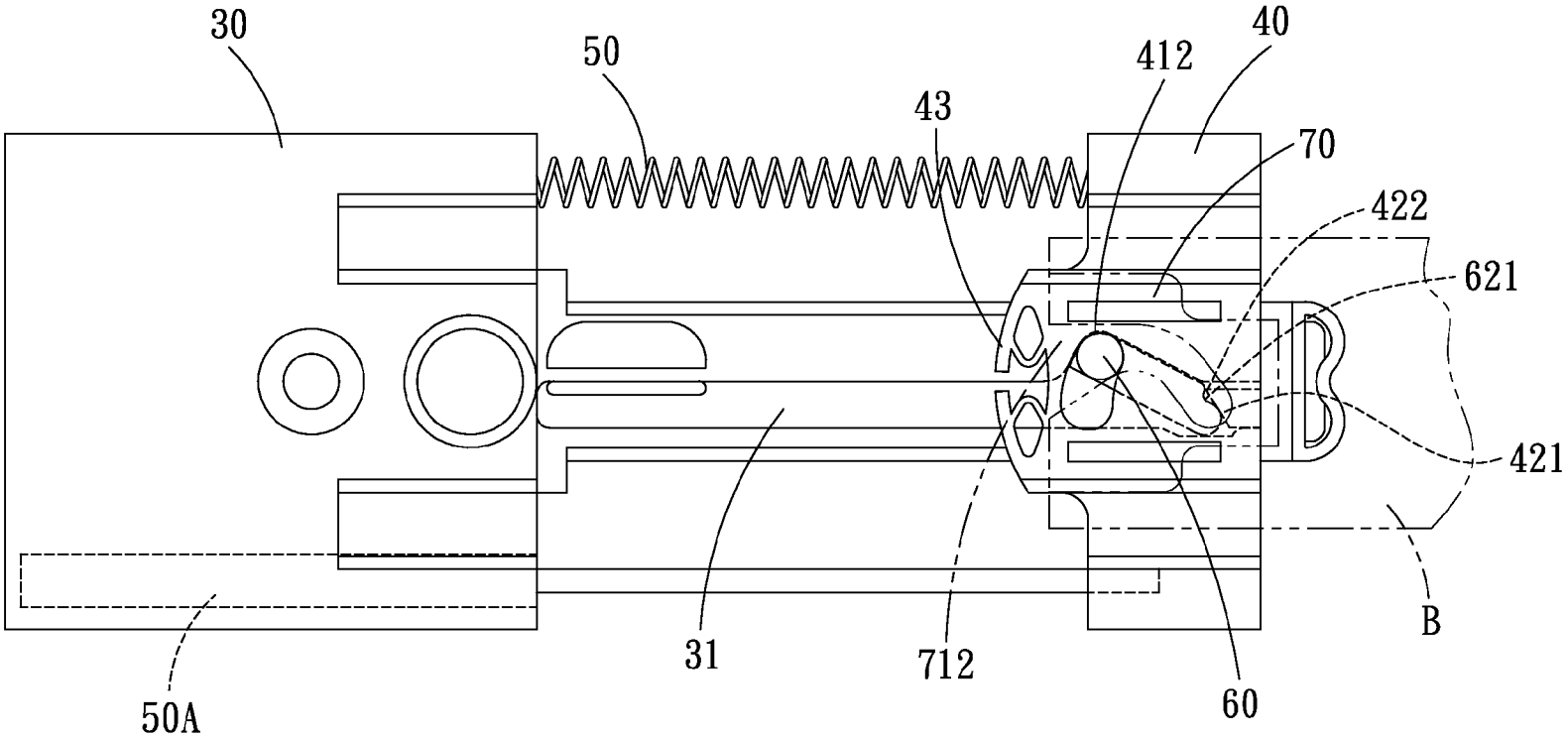
FIG. 10 is a plane assembly view showing the status of the return device for a drawer in accordance with the present invention when the drawer is pulled out and has been positioned.

When the drawer is closed, as shown in FIGS. 6-10, the protrusion 61 of the slide block 60 is received in the bottom 711 of the actuating slot 71, the elastic member 50 and the buffering cylinder 50A between the pulling member 40 and the positioning member 30 are in a non-stretched state, and the buffering portion 43 is abutted against the positioning member 30 (as shown in FIG. 7). When the drawer is opened, the pulling seat B on the drawer is pulled outward synchronously with the drawer, so that the actuating slot 71 of the actuator 70 on the pulling seat B synchronously drives the slide block 60 to move, and the slide block 60 moves the pulling member 40. Meanwhile, the slide block 60 slides outward along the track 31 of the positioning member 30 and stretches the elastic member 50 and the buffering cylinder 50A (as shown in FIG. 8). When the slide block 60 slides into the positioning concave 311 of the track 31 of the positioning member 30, the actuating slot 71 and the slide slot 41 force the slide block 60 to slide toward the open end 712 of the actuating slot 71 and the open end 412 of the slide slot 41 (as shown in FIG. 10). Since the top portion 622 of the slide portion 62 of the slide block 60 is abutted against the slope 421 of the engaging portion 42 of the pulling member 40, when the slide block 60 is subjected to a force, the arch-shaped top portion 622 will slide by pivoting against the slope 421 of the engaging portion 42. During sliding movement, the slide block 60 also changes its position within the slide slot 41 of the pulling member 40. When its protrusion 61 slides into the concave 311 of the positioning member 30, the slide block 60 is right received in the receiving concave 312 of the positioning member 30, meanwhile, it also slides to the open end 712 of the actuating slot 71 and the open end 412 of the slide slot 41, where the actuator 70 disengages from the slide block 60, and accordingly the drawer is allowed to be pulled out. It is to be noted that the reason why the slide block 60 can be stably positioned in the positioning concave 311 of the positioning member 30 is because that the arch-shaped top portion 622 of the slide block 60 will be affected by the elastic force of the elastic member 50 when it abutted against the slope 421 of the engaging portion 42, so that the slide block 60 can be positioned and prevented from disengagement.

When user wants to push the drawer back, pushing the drawer back can make the pulling seat B on the drawer and the actuator 70 to slide inward. When the actuating slot 71 of the actuator 70 touches the slide block 60, the slide block 60 will slide into the actuating slot 71 via the open end 712. Then keep pushing to make the slide block 60 slide to the bottom 711 of the actuating slot 71, where the slide block 60 is positioned with respect to the actuator 70, and to make the slide block 60 slide toward the slide end 411 of the pulling member 40, meanwhile, the slide block 60 also moves from the positioning concave 311 of the positioning member 30 into the track 31. After sliding into the track 31 of the positioning member 30, the slide block 60 is not positioned (loses the power of being positioned) and will be affect by the pulling force of the elastic member 50 to synchronously drive the pulling member 40, the actuating member 70 and the drawer to their original position. When the pulling member 40 is being pulled back by the elastic member 50, the buffering cylinder 50A between the pulling member 40 and the positioning member 30 can slow down the moving speed of the pulling member 40, thus slowing down the return motion of the drawer while reducing the force for pushing the drawer backward, which can prevent the drawer from sliding back too fast and biting fingers. In addition, at the side of the pulling member 40 close to the positioning member 30 is provided the buffering portion 43, which cushions the shock and noise caused when the pulling member 40 returns and pushes against the positioning member 30.

It is to be noted that since the angle between slide surface 313 of the positioning concave 311 of the positioning member 30 and the track 31 is obtuse, which makes the route along which the slide block 60 slide into and out of the positioning concave 311 have the slide surface 313 to guide the movement of the slide block 60, so that it easier for the slide block 60 to slide in and out by moving the slide surface 313. In other words, the force required by the slide block 60 to position in or disengage from the positioning concave 311 must be relatively small. Hence, the drawer can be pushed back effortlessly without requiring a great force to be exerted by the user. Furthermore, in this embodiment, there are the elastic member 50 and the buffering cylinder 50A disposed between the positioning member 30 and the pulling member 40, in fact, however, with only the elastic member 50 can also achieve the function of automatically returning the drawer.

While we have shown and described various embodiments in accordance with the present invention, it is clear to those skilled in the art that further embodiments may be made without departing from the scope of the present invention.

What is claimed is:

1. A return device for a drawer comprising:

a positioning member having a track and a positioning concave formed at one side of the track;

a pulling member slidably disposed on the positioning member and having a slide slot;

an elastic member connected to the positioning member and the pulling member;

a slide block having a protrusion to be received in the slide slot of the pulling member and a slide portion to be disposed in the track of the positioning member, and the protrusion being located close to one end of the slide portion; and an actuator including an actuating slot for receiving the protrusion of the slide block and capable of making the protrusion of the slide bock slide in and out of the positioning concave of the track;

characterized in that: the positioning concave has a slide surface which defines an obtuse angle with respect to the track, and the obtuse angle is in the range of 235-245 degrees, at one end of the slide portion are formed an indentation and an arch-shaped top portion, the pulling member is formed with an engaging portion, the engaging portion includes a slope formed in a longitudinal direction thereof, so that the top portion is able to move by pivoting against the slope of the engaging portion of the pulling member, the indentation of the slide portion makes room for a protruding corner of the slope of the engaging portion during rotation of the slide portion, so that another end of the slide portion is able to drive the protrusion to move from a slide end to a positioning end of the slide slot.

2. The return device for a drawer as claimed in claim 1, wherein the pulling member further includes a buffering portion located at one side thereof opposite the engaging portion and employed to contact the positioning member.

3. The return device for a drawer as claimed in claim 1 further comprising a buffering cylinder with two ends connected to the positioning member and the pulling member, respectively.

4. The return device for a drawer as claimed in claim 3, wherein the elastic member and the buffering cylinder are disposed at both sides of the positioning member.

5. The return device for a drawer as claimed in claim 3, wherein the buffering cylinder is an oil pressure cylinder.

6. The return device for a drawer as claimed in claim 3, wherein the buffering cylinder is an air cylinder.

7. The return device for a drawer as claimed in claim 1, wherein the obtuse angle is 240 degrees.

* * * * *